US006168365B1

(12) United States Patent
Lee

(10) Patent No.: US 6,168,365 B1
(45) Date of Patent: Jan. 2, 2001

(54) PARKING FACILITY WITH MOVABLE PALLETS FOR CARRYING VEHICLES TO STORAGE LOCATIONS

(75) Inventor: Sang Seon Lee, Kyoungsangnam-do (KR)

(73) Assignee: LG Industrial Systems Co., Ltd., Seoul (KR)

( * ) Notice: Under 35 U.S.C. 154(b), the term of this patent shall be extended for 0 days.

(21) Appl. No.: 09/350,569

(22) Filed: Jul. 7, 1999

(30) Foreign Application Priority Data

Jul. 13, 1998 (KR) ..... 98-28176

(51) Int. Cl.[7] ..... B66F 7/00
(52) U.S. Cl. ..... 414/253; 414/264; 414/280
(58) Field of Search ..... 414/252, 253, 414/259, 264, 277, 279, 280

(56) References Cited

U.S. PATENT DOCUMENTS

| | | | | |
|---|---|---|---|---|
| 2,714,456 | * | 8/1955 | Manaugh | 414/253 |
| 2,994,445 | * | 8/1961 | Roth | 414/252 X |
| 4,372,219 | * | 2/1983 | Gibbs | 414/286 X |
| 4,768,914 | * | 9/1988 | Sing | 414/286 X |
| 5,022,808 | * | 6/1991 | Blum et al. | 414/280 |
| 5,165,842 | | 11/1992 | Hammer . | |
| 5,437,536 | | 8/1995 | Bianca . | |
| 5,573,364 | | 11/1996 | Schneider et al. . | |

* cited by examiner

*Primary Examiner*—Robert P. Olszewski
*Assistant Examiner*—Gerald J. O'Connor
(74) *Attorney, Agent, or Firm*—Birch, Stewart, Kolasch & Birch, LLP

(57) ABSTRACT

A parking installation comprising a pallet on which a vehicle is loaded, wherein a guide member is formed on a lower surface of the pallet along its longitudinal center line; a carrier for loading the pallet thereon, the carrier traveling along a traveling rail extending across parking rooms; travel rollers mounted at both ends of the carrier for rolling on the traveling rail; a first driving motor connected to a shaft of the travel roller for supplying a driving force to rotate the travel roller; a pallet transferring unit mounted rotatably to both ends of the carrier, the unit being in contact with the guide member and transferring the pallet longitudinally; and a pallet drawing/pushing assembly mounted adjacent to the pallet having a pivotable arm pivotable along a predetermined arc, the pivotable arm of the pallet drawing/pushing assembly either drawing a stopper formed on a lower surface of the pallet such that the guide member of the pallet comes in contact with the pallet transferring unit or pushing the stopper such that the guide member of the pallet departs from the pallet transferring unit.

9 Claims, 7 Drawing Sheets

PARKING FACILITY WITH MOVABLE PALLETS FOR CARRYING VEHICLES TO STORAGE LOCATIONS

BACKGROUND OF THE INVENTION

1. Technical Field

The present invention relates to a carrier in a parallel-type parking installation, in particular to an improved pallet carrying apparatus for carrying a pallet having a vehicle thereon between a lift in a hoistway and parking rooms, which has a simple structure, a lower manufacturing cost, a less breakdown and an accurate and fast movement of pallets.

2. Description of the Prior Art

A parallel-type parking installation has a growing interest these days because of increasing parking difficulties. Generally, the parallel-type parking installation is mounted in a basement of a large building, an underground of a park, or a parking lot to have a plurality of floors. A general parallel-type parking installation is shown in FIG. 1 and FIG. 2. As shown in the figures, the parallel-type parking installation includes a hoistway 1 passing through floors and a plurality of parking rooms 2 positioned in each floor. In the hoistway 1, a lift 3 is mounted. On the lift 3, a pallet 4 can be laid for loading a vehicle thereon. With the pallet 4 loading a vehicle thereon, the lift 3 can move the vehicle vertically to a desired floor through the hoistway 1.

The parking rooms 2 are generally separated in two rows and arranged side by side in each floor, between which two rows a carrier C and a traveling rail 5 are located. The carrier C can travel along the traveling rail 5 with its rollers. After loading the pallet 4 having a vehicle thereon from the lift 3, the carrier C moves the vehicle to a respective parking room along the traveling rail 5. Because the carrier C can move at a high speed, the carrier C may load or unload a vehicle as fast as possible.

Furthermore, since the parking installation may have a different configuration according to its mounting circumference, a configuration of the carrier C can be modified depending on the parking installation.

FIG. 3 and FIG. 4 are a plane view and a front view of the conventional carrier C respectively. Referring to the figures, the carrier C of the parallel-type parking installation roughly consists of upper and lower frames 10, 20, a travel driving unit M and a pallet transferring unit T. The upper and lower frames 10, 20 form a figure of the carrier C, which travels along the traveling rail 5 located between two rows of a plurality of the parking rooms 2. The travel driving units M are mounted on each end of the upper and lower frames 10, 20 for giving a driving force such that the carrier C can travel along the traveling rail 5. The pallet transferring unit T at both ends of an upper surface of the upper frame 20 makes the pallet 4 loaded on or unloaded from the carrier C.

The travel driving unit M, in detail, includes a travel roller 12 rolling along and in contact with the traveling rail 5, a motor 11 for supplying a power to the travel roller 12 and a driving shaft of the motor 11.

The pallet transferring unit T includes a plurality of transferring rollers 21, which are arranged serially in both sides on the upper frame 20 with an appropriate interval. A chain sprocket, not shown in figures, is attached to the transferring rollers 21, which connected by a chain 27. The transferring rollers 21 roll with use of a driving force from a separate transferring motor 28 through the chain 27 for loading the pallet 4 on the carrier C. The pallet transferring unit T also includes drawing rollers 22, which are respectively connected to corners of the upper frame 20 for moving vertically. The drawing roller 22 is connected to an arm 24, which can rotate within a certain angle range by being pushed or drawn by a hydraulic cylinder 23. As the arm 24 rotates, the drawing rollers 22 lift the pallet 4 upward such that the pallet 4 can move.

Operation of the carrier C as constructed above is as follows. At first, a driver loads a vehicle on the pallet 4, which is positioned on the lift 3 in a stand-by state at an entrance of the parking lot. After that, when the driver presses a "parking" button on a control panel (not shown), the lift 3 moves to a designated floor in which a parking space remains.

At this time, the carrier C, which have executed a previous loading/unloading process, is positioned near the lift 3 in a stand-by state. The pallet 4, moved to the designated floor on the lift 3, is then slid and loaded on the carrier C together with the vehicle thereon. After that, as the travel rollers 12 roll with use of the power of the travel motor 11, the carrier C having the pallet 4 and the vehicle thereon travels along the traveling rail 5 and stops at a position of the designated parking room 2.

When the carrier C reaches at the designated parking room 2, the transferring motor 28 of the pallet transferring unit T is activated for rotating a plurality of the transferring rollers 21. As the transferring rollers 21 rotate, the pallet 4 having the vehicle moves to a parking area in the parking room. At time that about 4/5 in length of the pallet 4 enters in the parking room, the hydraulic cylinder 23 is activated. The hydraulic cylinder 23 lifts the drawing roller 22 through the arm 24 such that the pallet 4 can move to a regular parking position in the parking room.

On the other hand, the process is reversed when moving the pallet 4 from the parking room 2 onto the carrier C. At first, the pallet transferring unit T of the carrier C is activated for rotating the transferring rollers 21, and, at the same time, the hydraulic cylinder 23 is activated for lifting the drawing rollers 22 upward through the arms 24. Because the drawing roller 22 is rotated for lifting a bottom surface of the pallet 4, the pallet 4 is slightly moved toward the carrier C. Then, the pallet 4 moves to a regular loading position on the carrier C with use of a plurality of the transferring rollers 21.

However, the above-explained conventional pallet transferring unit T has a very complex structure in fact that the unit should include a plurality of the transferring rollers 21 and the drawing rollers 22, the transferring motor 28 and the chain 27 for driving the transferring rollers 21, and the hydraulic cylinder 23 for driving the drawing roller 22. In addition, according to the complex configuration the conventional pallet transferring unit has problems of frequent breakdowns and high manufacturing cost.

SUMMARY OF THE INVENTION

Therefore, the present invention is designed to overcome problems of the prior art, so objects of the invention are to provide an enhanced pallet transferring unit in a parking installation which has a simple structure, a low manufacturing cost, less breakdowns and an accurate and fast movement of pallets.

In order to obtain the above object, one embodiment of the present invention provides a parking installation which comprises a pallet on which a vehicle is loaded, wherein a guide member is formed on a lower surface of the pallet along its longitudinal center line;

a carrier for loading the pallet thereon, the carrier traveling along a traveling rail formed across parking rooms;

travel rollers mounted at both ends of the carrier for rolling on the traveling rail;

first driving motor connected to a shaft of the travel roller for supplying a driving force to rotate the travel roller;

pallet transferring means mounted rotatably to both ends of the carrier, the means being in contact with the guide member and transferring the pallet longitudinally; and including a pivotable arm with a fixed end pallet drawing/pushing means mounted adjacent to the pallet transferring means to rotate the pivotable arm through a predetermined arc about the fixed end, the pallet drawing/pushing means either drawing a stopper formed on a lower surface of the pallet such that the guide member of the pallet comes in contact with the pallet transferring means or pushing the stopper such that the guide member of the pallet departs from the pallet transferring means.

In the parking installation, the pallet transferring means can be a friction gear, which rotates in contact with the guide member of the pallet.

The pallet transferring means comprises a pair of friction gears disposed at both sides of the guide member of the pallet and in contact with the guide member, the friction gears transferring the guide member with a frictional rotating force, a chain sprocket mounted to a rotating shaft of the friction gear; and third driving motor connected to the chain sprocket by a chain, the third driving motor supplying a rotating force such that the friction gear rotates in a clockwise/counterclockwise direction.

The pallet drawing/pushing means can be a rotating arm, which moves in a certain trace to be blocked at the stopper.

The pallet drawing/pushing means comprises rotating shafts rotatably mounted to both ends of the carrier respectively;

rotating arms mounted to the rotating shaft, the rotating arm rotating in a certain trace to stop at the stopper formed at both ends of the pallet;

contact rollers rotatably mounted to ends of the rotating arms;

chain sprockets mounted to the rotating shafts; and second driving motors connected to the chain sprockets with use of chains, the second driving motor supplying a rotating force such that the rotating shaft rotates in a clockwise/counterclockwise direction.

In order to accomplish the above objects, another embodiment of the present invention provides a parking installation which comprises a pallet on which a vehicle is loaded, wherein a guide member is formed on a lower surface of the pallet along its longitudinal center line;

a lift mounted to move vertically through a hoistway with the pallet thereon, a carrier for loading/unloading the pallet from/to the lift, the carrier traveling along a traveling rail formed across parking rooms, wherein the carrier includes an upper frame and a lower frame;

travel rollers mounted at both ends of the lower frame of the carrier for rolling on the traveling rail;

first driving motor connected to a shaft of the travel roller for supplying a driving force to rotate the travel roller;

pallet transferring means mounted rotatably to both ends of the upper frame of the carrier, the means being in contact with the guide member and transferring the pallet longitudinally; and pallet drawing/pushing means including a pivotable arm with a fixed end mounted adjacent to the pallet transferring means for rotation through a predetermined arc about the fixed end, the pallet drawing/pushing means either drawing a stopper formed on a lower surface of the pallet such that the guide member of the pallet comes in contact with the pallet transferring means or pushing the stopper such that the guide member of the pallet departs from the pallet transferring means.

BRIEF DESCRIPTION OF THE DRAWINGS

Other objects, features and advantages of the present invention will become more apparent from the description of a preferable embodiment with reference to the drawings, in which.

DETAILED DESCRIPTION OF THE PREFERRED EMBODIMENT

Hereinafter, the present invention will be described in detail in accordance with the accompanying drawings.

Figure 1:
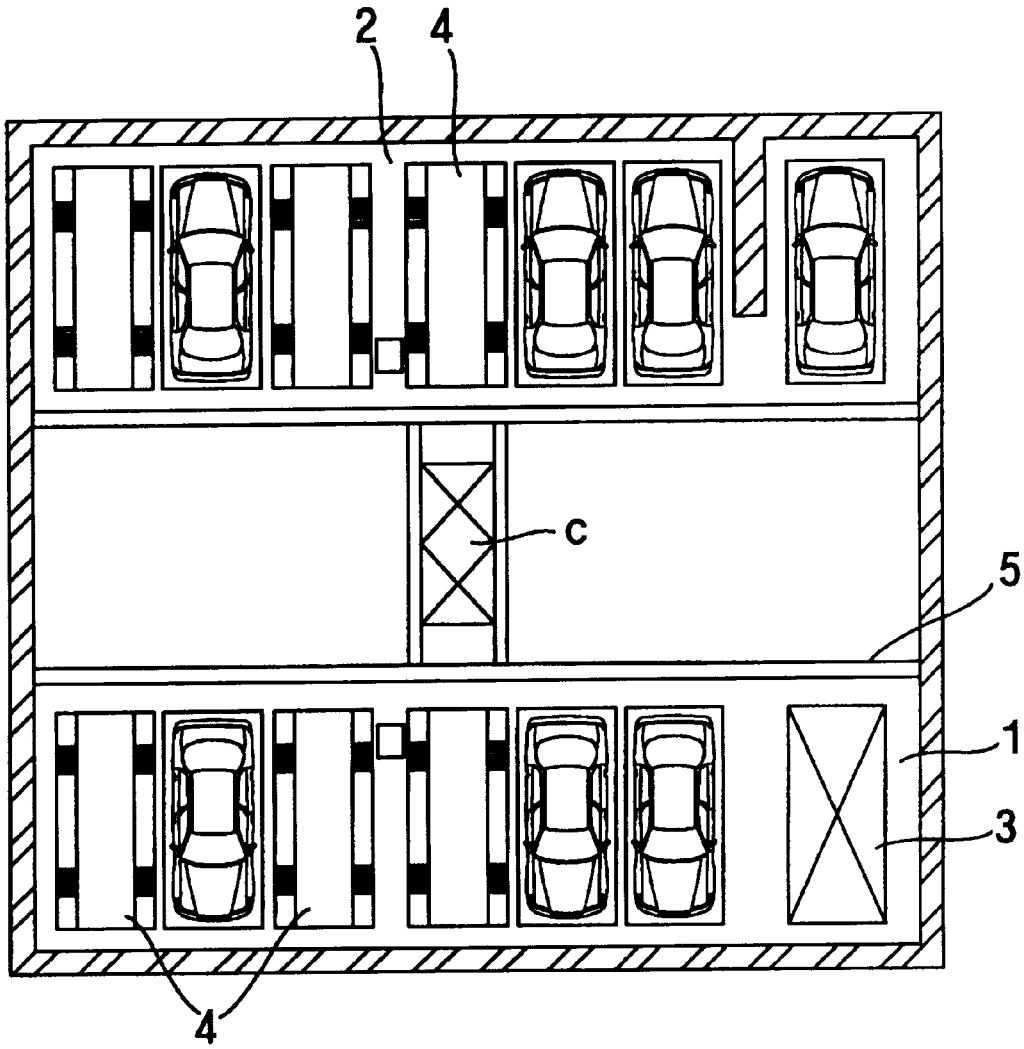
FIG. 1 (PRIOR ART)
FIG. 1 is a plan view schematically showing a configuration of a conventional parallel-type parking installation.
Figure 2:
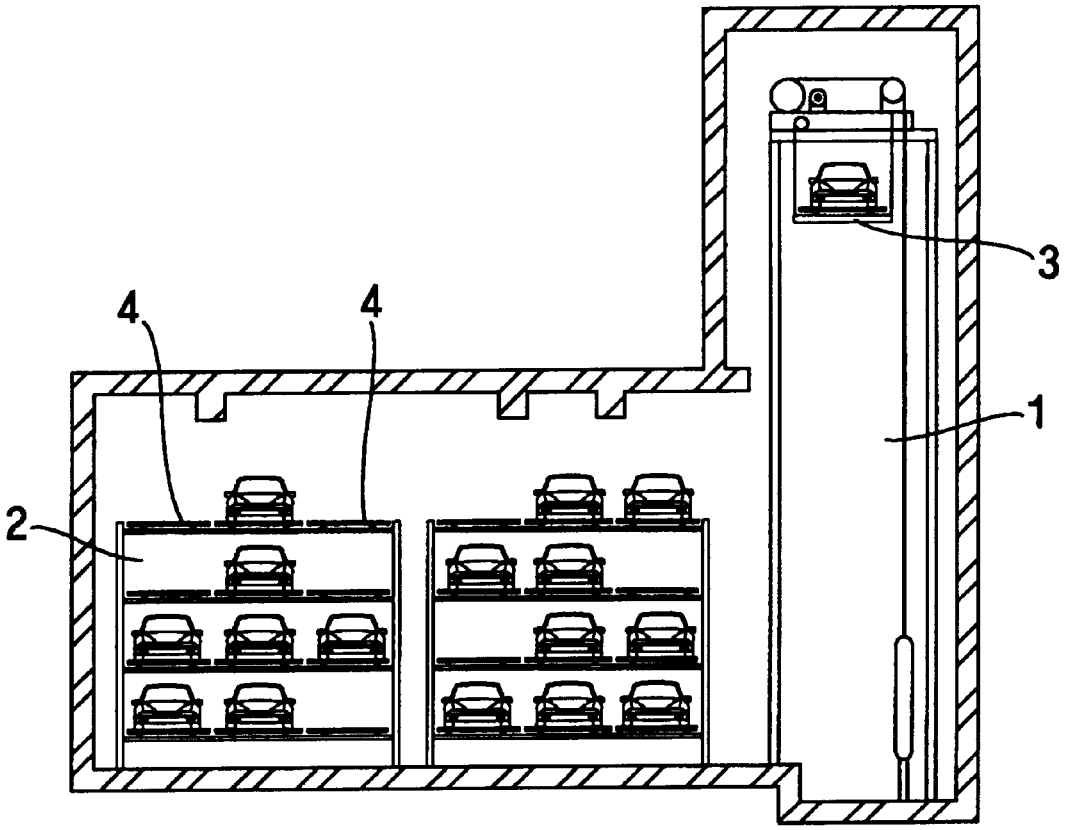
FIG. 2 (PRIOR ART)
FIG. 2 is a front view schematically showing the configuration of the conventional parallel-type parking installation.
Figure 3:
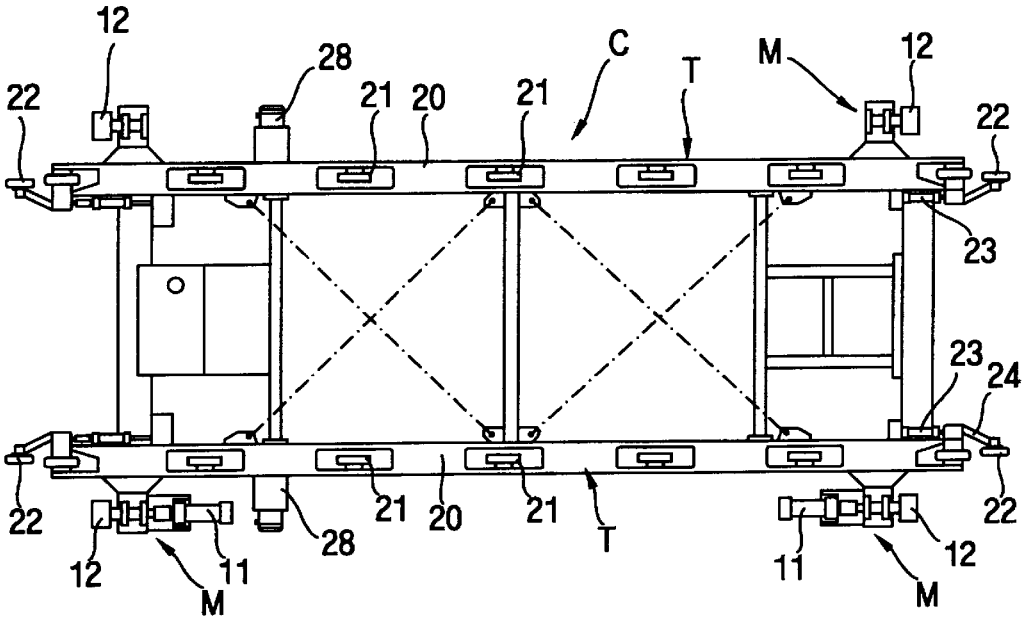
FIG. 3 (PRIOR ART)
FIG. 3 is a plan view showing a carrier used in a parallel-type parking installation of the prior art.
Figure 4:
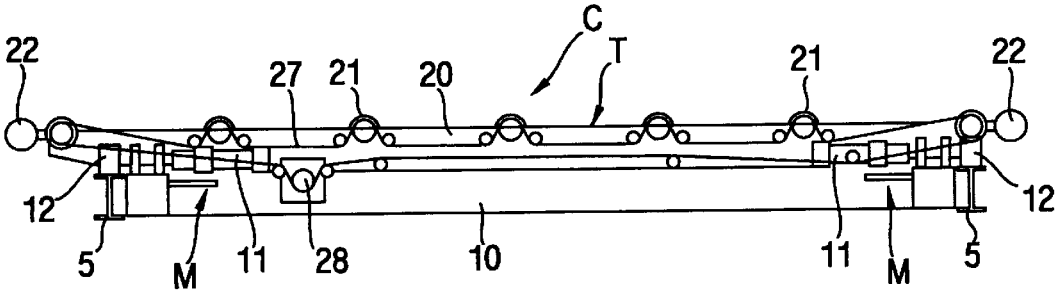
FIG. 4 (PRIOR ART)
FIG. 4 is a front view showing the carrier used in the parallel-type parking installation of the prior art.
Figure 5:
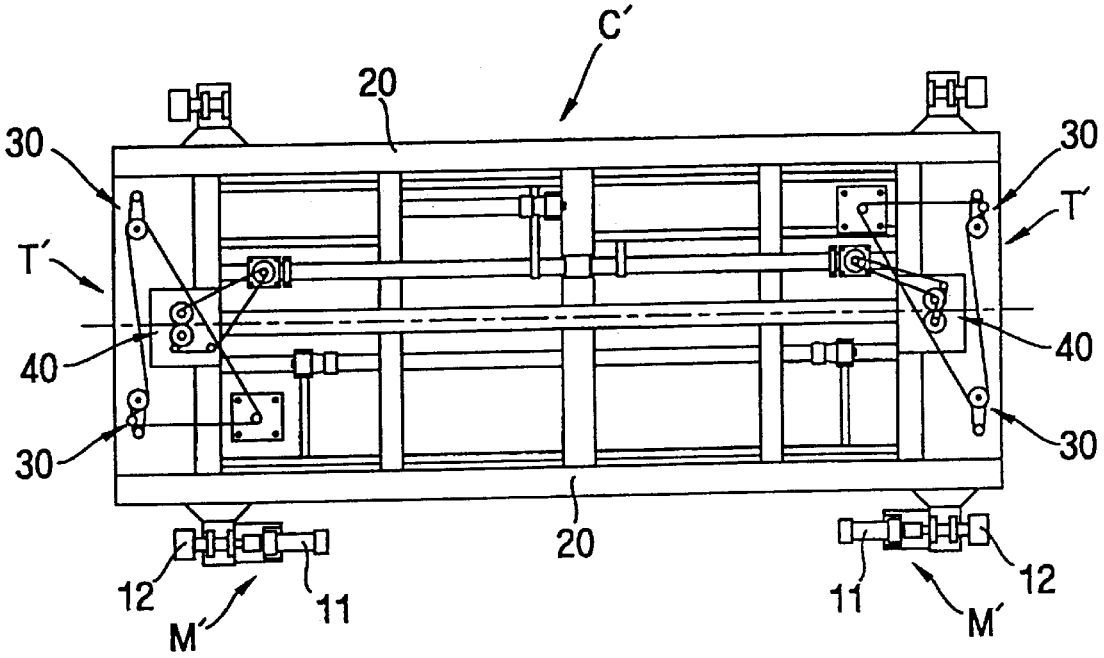
FIG. 5 is a plan view showing a carrier used in a parallel-type parking installation of the present invention.
Figure 6:
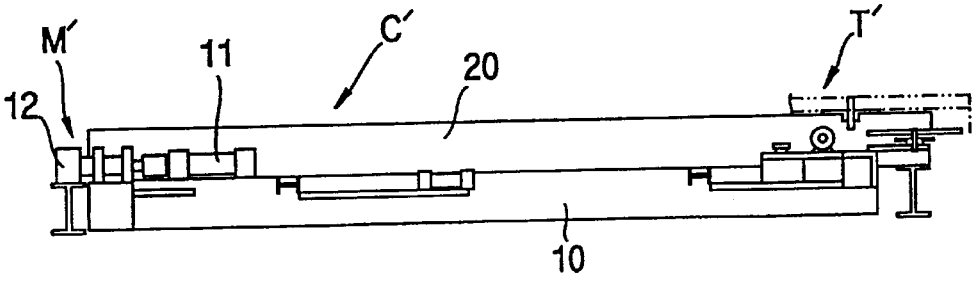
FIG. 6 is a front view showing the carrier used in the parallel-type parking installation of the present invention.
Figure 7:
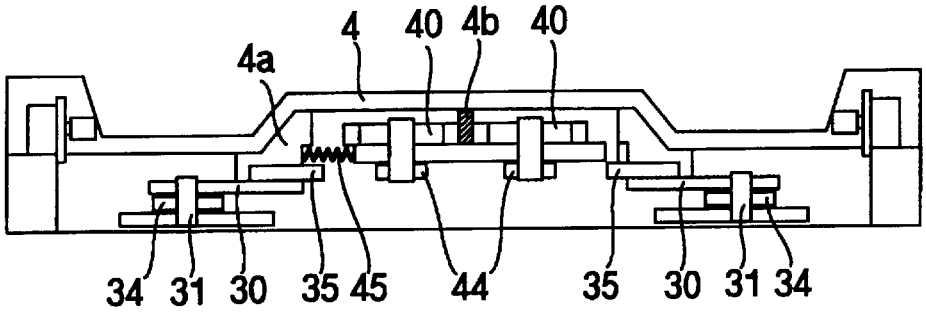
FIG. 7 is a side view showing the carrier used in the parallel-type parking installation of the present invention.

FIG. 5 to FIG. 7 respectively show a carrier C' in a parking installation according to the present invention. As shown in the figures, the carrier C' in the parking installation according to the present invention includes upper and lower frames 20, 10, a travel driving unit M' and a pallet transferring unit T'. The upper and lower frames 20, 10 move with their rollers on and along a traveling rail 5 disposed between a plurality of parking rooms 2, which are arranged in two opposite rows. The travel driving unit M' is mounted at each end of the upper and lower frames 20, 10 for supplying a driving force such that the carrier C' can travel along the traveling rail 5. The pallet transferring unit T' transfers the pallet 4 at an upper surface of each end of the upper frame 20 by using a friction gear 40.

The travel driving unit M' includes a travel roller 12 for rolling along and in contact with the traveling rail 5 and a first driving motor 11 for supplying a power to the traveling rollers 12.

Figure 8:
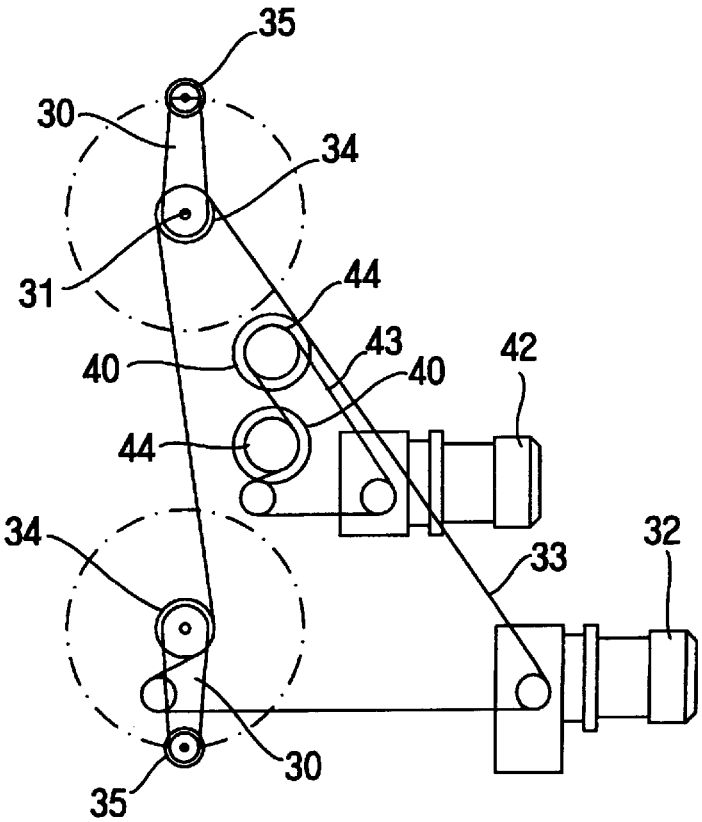
FIG. 8 is an enlarged plan view showing a pallet transferring unit applied to the carrier of the present invention in FIG. 5 through FIG. 7.

The pallet transferring unit T' is disposed at both ends of the carrier C', which is best shown in FIG. 7 showing a side view of the carrier C'. The pallet transferring unit T' is now described referring to FIG. 7 and FIG. 8 showing an enlarged view of the pallet transferring unit T', in detail.

At both sides of the carrier C', pivotable arms 30 are mounted. At a rotating shaft 31 of the rotating arm 30 mounted is a chain sprocket 34 which supplies a driving force from a second driving motor 32 to the rotating arm 30. A contact roller 35 is located at an end of the rotating arm 30. The contact roller 35 is rotating in contact with a stopper 4*a* formed on a lower surface of the pallet 4 in order to move the pallet 4. The stopper 4*a* has predetermined width and depth, being located in a certain height where a lower end thereof is in contact with the contact roller 35 and not in contact with the pivoting arm 30 during rotation of the pivoting arm 30.

A pair of friction gears 40 is disposed within the pivoting arms 30. The friction gears 40 are spaced apart at a predetermined distance, between which a guide member 4*b* formed on a lower surface of the pallet 4 along its longitudinal center line is interposed. The guide member 4*b* is preferably formed in a squared shape. A pair of the friction gears 40 rotate with pressure against the guide member 4*b* such that the pallet 4 can move longitudinally under their friction with the guide member 4*b*.

The travel driving unit M' also includes second and third driving motors 32, 42 and chains 33, 43, all of which are used for supplying power to the pivoting arms 30 and the friction gears 40, respectively. The second and third driving motors 32, 42 and the chains 33, 43 can be manually controlled to rotate in a clockwise/counterclockwise direction.

The friction gear 40 is made by coating urethane or synthetic rubber around an iron core. To a shaft of the friction gear 40, mounted is a chain sprocket 44, which supplies a driving force from the third driving motor 42 to the friction gear 40. A spring 45 is disposed outside the friction gear 40 for pressing the friction gear 40 inwardly from outside. The third driving motor 42 and the friction gear 40 are engaged each other for interlocking with a bevel gear.

Figure 9A:
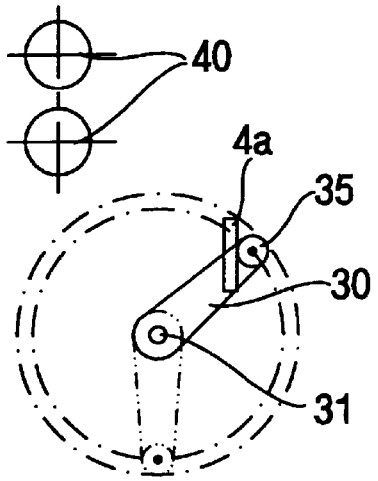
FIGS. 9A to 9C are sequentially showing operation of a rotating arm and a friction gear of the pallet transferring unit when loading a pallet on the carrier of the present invention.
Figure 9B:
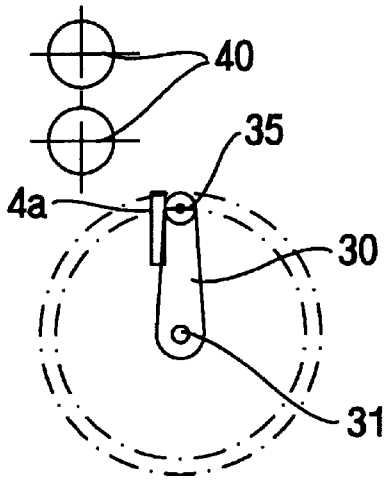

FIG. 9A and FIG. 9B are sequentially showing operations of the friction gear 40 and the pivoting arm 30 when loading the pallet 4 onto the carrier C'.

When loading the pallet 4 from the parking room 2 onto the carrier C', at first, the carrier C' moves toward the corresponding parking room 2. At this time, the pallet 4 is positioned in a parking position of the parking room 2. When the pallet 4 is in the parking position, the stopper 4*a* of the pallet 4 is stopped in a position shown in FIG. 9A, and an end of the guide member 4*b* is located in an approximately same line with the stopper 4*a*.

Figure 9C:
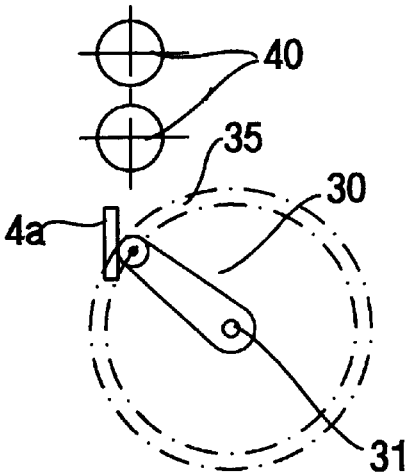

Then, the second driving motor 32 of the carrier C' supplies a power to the pivoting arm 30. The pivoting arm 30 rotates counterclockwise from an initial position (indicated in a dashed line in FIG. 9A) centering around the rotating shaft 31, and then the contact roller 35 on its end comes in contact with the stopper 4*a* of the pallet 4. The contact roller 35 pushes the stopper 4*a* until the guide member 4*b* of the pallet 4 is interposed between the friction gears 40. When the contact roller 35 reaches a position of FIG. 9C, the guide member 4*b* is inserted between the friction gears 40 and the friction gears 40 move the pallet 4 to a regular loading position with use of power from the third driving motor 42. After pushing the stopper 4*a*, the rotating arm 30 makes a round to its initial position.

Preferably, the second driving motor 32 driving the pivoting arm 30 is controlled by an inverter (not shown). By means of controlling the second driving motor 32 with use of the inverter, the pivoting arm 30 rotates at a high speed until the contact roller 35 reaches the stopper 4*a* of the pallet 4, while rotating at a low speed when the contact roller 35 sustains much load in contact with the stopper 4*a*.

Figure 10A:
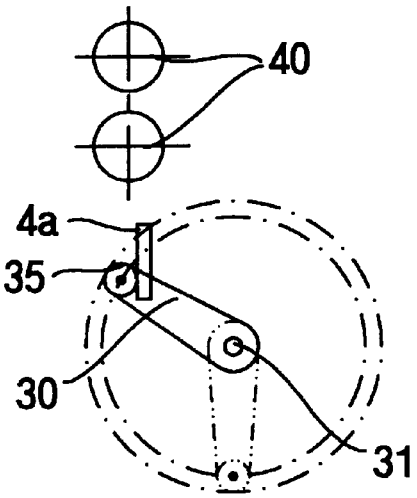
FIGS. 10A to 10C are sequentially showing operation of the rotating arm and the friction gear of the pallet transferring unit when unloading the pallet from the carrier of the present invention.
Figure 10B:
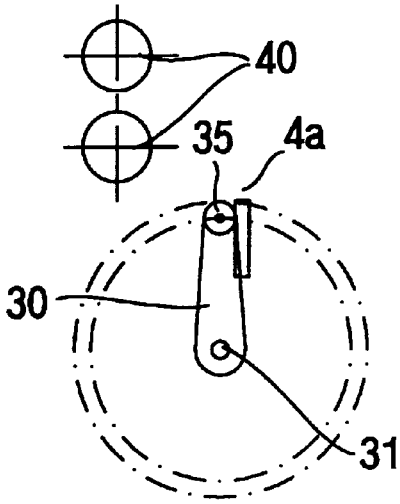
Figure 10C:
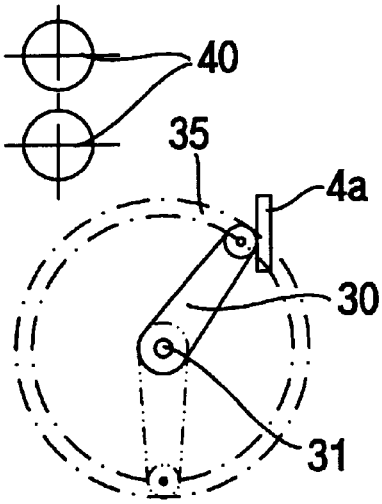

Referring to FIG. 10A to FIG. 10C, an unloading process of the pallet 4 is then explained.

At first, the carrier C' moves toward the corresponding parking room 2 along the traveling rail 5 with the pallet 4 thereon. A position of the stopper 4*a* of the pallet 4 on the carrier C' is identical to the regular loading position in the loading process. Then, while the friction gears 40 rotate and push the guide member 4*b* into the parking room by using friction, the pallet 4 enters the parking room 2. When a portion, for example 4/5 in length, of the pallet 4 enters the parking room 2, the pivoting arm 30 is then activated. The pivoting arm 30 is then rotated by the second driving motor 32. At this time, the stopper 4*a* of the pallet 4 is in a position of FIG. 10A, which has been moved right on the drawing. The pivoting arm 30 rotates from its initial position (also drawn as a dashed line in FIG. 10A) clockwise (opposite to the loading process), shown in FIG. 10B. Consequently, the contact roller 35 pushes the stopper 4*a* together with the pallet 4 to a parking position in the parking room 2. This is shown in FIG. 10C. When the pallet 4 moves to the parking position, the pivoting arm 30 rotates in a reverse direction back to the initial position, which makes the unloading process completed.

Based upon the above description, overall parking process is now described.

At first, a driver loads a vehicle onto the pallet 4, which is positioned on the lift 3 in a stand-by state at an entrance of the parking lot. After that, when the driver presses a "parking" button on a control panel (not shown in the figure), the lift 3 moves to a designated floor in which a parking space remains. At this time, the carrier C' travels near the lift 3 along the traveling rail 5. The pallet 4, moved to the designated floor on the lift 3, is then slid and loaded on the carrier C'. After that, as the travel rollers 12 roll with use of power of the travel motor 11, the carrier C' having the pallet 4 and the vehicle thereon travels along the traveling rail 5 and then stops at a position of the designated parking room 2. When the carrier C' reaches at the designated parking room, the pallet 4 is transferred into the parking room 2 according to the above described unloading process.

When manipulating a control panel (not shown) at an exit for an unloading process, the carrier C' moves to a position of a designated parking room. The pallet 4 in the corresponding parking room is transferred onto the carrier C' according to the above described loading process. The carrier C' having the pallet 4 thereon travels near the lift 3. When the pallet 4 is moved from the carrier C' into the lift 3, and then moved to the exit by the lift 3, the vehicle on the pallet 4 can be taken out from the parking installation.

Then, followings are some advantageous effects anticipated by the above configuration and operation of the present invention.

The carrier C' of the present invention can transfer the pallet 4 with a simpler structure using friction owing to a configuration in which each part can manually operated. Therefore, the carrier C' of the present invention has a lower manufacturing cost and less breakdown. In addition, the present invention can increase credibility of products with enhancement of speed, accuracy and flexibility of movement.

The pallet carrying apparatus in a parking installation according to the present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. A parking installation, comprising:

a pallet on which a vehicle may be loaded, and a guide member formed on a lower surface of the pallet along its longitudinal center line;

a carrier for loading the pallet thereon, the carrier being movable along a traveling rail extending across parking rooms;

travel rollers mounted at both ends of the carrier for rolling on the traveling rail;

first driving motors connected to a shaft of each travel roller for supplying a driving force to rotate the travel roller;

a pallet transferring mechanism mounted rotatably to both ends of the carrier, the mechanism being in contact with the guide member and transferring the pallet longitudinally of the carrier; and a pallet drawing/pushing assembly having a pivotable arm with a fixed end mounted adjacent to the pallet transferring mechanism to rotate the pivotable arm along a predetermined arc about the fixed end, the pallet drawing/pushing mechanism either drawing a stopper formed on a lower surface of the pallet such that the guide member of the pallet comes in contact with the pallet transferring mechanism, or pushing the stopper such that the guide member of the pallet departs from the pallet transferring mechanism.

2. A parking installation as claimed in claim 1, wherein the pallet transferring mechanism is a friction gear which rotates in contact with the guide member of the pallet.

3. A parking installation as claimed in claim 1, wherein the pallet transferring mechanism comprises:

a pair of friction gears disposed at both sides of the center line of the guide member of the pallet and in contact with the guide member, the friction gears transferring the guide member by a frictional rotating force, a chain sprocket mounted to a rotating shaft of the friction gear; and a third driving motor connected to the chain sprocket, the third driving motor supplying rotating forces to the friction gears.

4. A parking installation as claimed in claim 1, wherein the pallet drawing/pushing assembly comprises:

rotating shafts rotatably mounted to both ends of the carrier respectively;

one of said pivotable arms mounted to each of the rotating shafts;

a contact roller rotatably mounted to ends of the pivotable arms;

a chain sprocket mounted to the rotating shafts; and second driving motors connected to the chain sprocket, the second driving motors supplying rotating forces to the rotating shafts.

5. A parking installation as claimed in claim 1, wherein the pallet transferring mechanism comprises:

a pair of friction gears disposed at both sides of the guide member of the pallet in contact with the guide member, the friction gears transferring the guide member longitudinally by a frictional rotating force;

a chain sprocket mounted to a rotating shaft of the friction gear; and a third driving motor connected to the chain sprocket, the third driving motor supplying rotating forces to the friction gears, and wherein the pallet drawing/pushing assembly includes:

rotating shafts rotatably mounted to both ends of the carrier respectively;

a one of said pivotable arms mounted to the rotating shafts;

a contact roller rotatably mounted to an end of each of the pivotable arms;

a chain sprocket mounted to the rotating shaft; and second driving motors connected to the chain sprocket, the second driving motors supplying rotating forces to the rotating shafts.

6. A parking installation, comprising:

a pallet on which a vehicle may be loaded including a guide member formed on a lower surface of the pallet along a longitudinal center line thereof;

a lift mounted to move vertically through a hoistway with the pallet thereon, a carrier for loading/unloading the pallet from/to the lift, the carrier traveling along a traveling rail extending across parking rooms, wherein the carrier includes an upper frame and a lower frame;

travel rollers mounted at both ends of the lower frame of the carrier for rolling on the traveling rail;

a first driving motor connected to a shaft of the travel roller for supplying a driving force to rotate the travel roller;

a pallet transferring mechanism rotatably mounted to both ends of the upper frame of the carrier, the mechanism being in contact with the guide member and transferring the pallet longitudinally of the carrier; and a pallet drawing/pushing assembly having a pivotable arm with a fixed end mounted adjacent the pallet transferring mechanism to rotate the pivotable arm along a predetermined arc about the fixed end, the pallet drawing/pushing mechanism either drawing a stopper formed on a lower surface of the pallet such that the guide member of the pallet comes in contact with the pallet transferring mechanism, or pushing the stopper such that the guide member of the pallet departs from the pallet transferring mechanism.

7. A parking installation as claimed in claim 6, wherein the pallet transferring mechanism is a friction gear which rotates in contact with the guide member of the pallet.

8. A parking installation as claimed in claim 6, wherein the pallet transferring mechanism comprises:

a pair of friction gears disposed at both sides of the guide member of the pallet in contact with the guide member, the friction gears transferring the guide member longitudinally of the carrier with a frictional rotating force;

a chain sprocket mounted to a rotating shaft of the friction gear; and third driving motors connected to the chain sprocket, the third driving motors supplying rotating forces to the friction gears.

9. A parking installation as claimed in claim 6, wherein the pallet drawing/pushing assembly comprises:

rotating shafts rotatably mounted to both ends of the upper frame of the carrier respectively;

one of said rotating arms mounted to each of the rotating shafts the rotating arms;

contact rollers rotatably mounted to ends of the rotating arms;

a chain sprocket mounted to each of the rotating shafts; and a second driving motor connected to each of the chain sprockets, the second driving motor supplying rotating forces to the rotating shafts.

* * * * *